US006233896B1

(12) United States Patent
Coup

(10) Patent No.: US 6,233,896 B1
(45) Date of Patent: May 22, 2001

(54) FLOORING PANEL AND/OR FLOORING OF SUCH FLOORING PANELS AND/OR RELATED METHODS

(75) Inventor: Michael John Coup, Te Aroha (NZ)

(73) Assignee: Carter Holt Harvey Limited, Auckland (NZ)

( * ) Notice: Subject to any disclaimer, the term of this patent is extended or adjusted under 35 U.S.C. 154(b) by 0 days.

(21) Appl. No.: 09/179,825

(22) Filed: Oct. 28, 1998

(30) Foreign Application Priority Data

Oct. 28, 1997 (NZ) ..... 329058
Sep. 22, 1998 (NZ) ..... 330083

(51) Int. Cl.[7] ..... E04B 5/12

(52) U.S. Cl. ..... 52/586.1; 52/746.1; 52/480; 52/582.1; 156/304.3; 156/304.5

(58) Field of Search ..... 52/586.1, 746.1, 52/747.1, 480, 582.1; 156/304.3, 304.5

(56) References Cited

U.S. PATENT DOCUMENTS

| | | | | |
|---|---|---|---|---|
| 1,412,506 | * | 4/1922 | Carter | 52/586.1 |
| 1,655,699 | * | 1/1928 | Houston | 52/746.1 X |
| 1,799,729 | * | 4/1931 | Cadwallader | 52/586.1 |
| 2,751,946 | * | 6/1956 | Gramelspacher | 52/746.1 X |
| 3,149,693 | * | 9/1964 | Keller et al. | 52/746.1 X |
| 3,276,941 | * | 10/1966 | Burns | 156/304.3 |
| 3,362,120 | * | 1/1968 | Warren | 52/746.1 X |
| 3,374,703 | * | 3/1968 | Davis et al. | 52/586.1 X |
| 4,169,688 | * | 10/1979 | Toshio | 52/586.1 X |
| 4,443,988 | * | 4/1984 | Coutu, Sr. | 52/586.1 X |
| 4,716,704 | * | 1/1988 | Murr | 52/586.1 X |
| 4,880,679 | * | 11/1989 | Bonazza | 428/57 |
| 5,438,809 | * | 8/1995 | Ehrlich | 52/586.1 X |
| 5,465,546 | * | 11/1995 | Buse | 52/586.1 X |
| 5,472,755 | * | 12/1995 | Nibling | 428/40 |
| 5,628,158 | * | 5/1997 | Porter | 52/586.1 X |

FOREIGN PATENT DOCUMENTS

| | | | | |
|---|---|---|---|---|
| 428920 | * | 5/1935 | (GB) | 52/480 |

* cited by examiner

*Primary Examiner*—Carl D. Friedman
*Assistant Examiner*—Phi Dieu Tran A
(74) *Attorney, Agent, or Firm*—Jacobson, Price, Holman & Stern, PLLC

(57) ABSTRACT

A method of flooring using butting panels fixed to a frame primarily of joists, joints transverse of the longitudinal axes of the joists being largely unnogged. To support such joints unsupported by a framing element reliance is placed on panel edge to panel edge adhesion.

In a preferred form particle board panels each provided with an edge groove have the effect of ensuring both a sufficient availability of adhesive for an effective butt joint whilst, in addition, providing a keying or splining between the adjacent panels.

16 Claims, 13 Drawing Sheets

FLOORING PANEL AND/OR FLOORING OF SUCH FLOORING PANELS AND/OR RELATED METHODS

TECHNICAL FIELD

The present invention relates to flooring panels, flooring provided by such panels, methods of providing a floor, flooring thus provided and panels for use in such a method.

Panels for flooring are usually (but not necessarily) made of a reconstituted material which includes wood fibres. Examples include particle board, plywood and other fibre boards. Typical of such materials used as flooring panels are KOPINE™ panels of this company which is a high density particle board. Other suitable materials for such flooring may include the PYNEFLOOR™ particle board product of Fletcher Wood Panels.

Prior art flooring procedures where flooring planks or panels are to be used have involved the extensive use of nogs between the joists of the flooring frame. Such complex suspended flooring frames are time consuming and costly. Timber nogs are not without a material cost and also take time to measure, cut and nail in place.

Over a period of time nogs can give uneven support of an overlying panel owing to drying or warping, thus eventually allowing movement and squeaking.

With such complex nog including suspended floor frames it is usual to abut the edges of the panels on a joist, some peripheral timber member or a nog and to attach the panel by appropriate penetrative means (eg. nails, screws or the like) or adhesive or both.

A variant on the abutment of straight cut edge panels is a tongue and groove type insert engagement of a kind that traditionally was used with timber planks. Such arrangements however involve the exposure to potential damage (prior to fitment) of the tongues and grooves. There is also a need to match male with female edges.

DISCLOSURE OF INVENTION

The present invention recognises economies of material, time and money that can arise if there is evolved a satisfactory system using flooring panels less susceptible to panel edge damage yet which can be fixed to a suspended floor frame primarily of joists without a need or any significant need for nogs under abutments of panels which are to run perpendicular to the run of the joists. It is therefore an object of the present invention to provide panels, methods and flooring which at least provides some of the aforementioned advantages.

In a first aspect the present invention consists in a method of edgewise joining flooring panels which comprises positioning a first panel on a flooring frame including joists, said panel having an edge (preferably provided with at least one groove), which edge does not run along the longitudinal axis of a joist, and positioning a second panel on the flooring frame having an edge (preferably provided with at least one groove complementary to that of said first panel), wherein said method includes the additional steps of applying adhesive to at least one of said (preferably grooved) edges and then bringing the panels substantially together prior to fixing or allowing the fixing of the panels or the second panel to the frame, the adhesive being applied in such a way and being of a kind whereby there is an adhesive joint having a resistance in shear to relative vertical movement of the panel edges (as well as preferably a forming of a spline between the panels moulded at least in part by the preferred said complementary grooves).

In some forms a non grooved square edge may be utilised. In other forms grooves and/or holes and/or depressions in such edges may be provided.

Preferably said panels are each of a composite which includes wood fibre material or at least included wood fibre material.

Preferably said first panel is fixed prior to the positioning and fixing of the second panel.

Preferably the fixing of each panel comprises or includes nailing and/or screwing into said joists.

Preferably the panel to panel adhered and adhesive formed splined joint does not overlie nogs.

Preferably said panels are rectangular and are grooved on two opposed sides only, such sides being normal to the run of the joists.

Preferably said panels are rectangular and at least the two longer sides are grooved.

Preferably those edges of panels to be adjacent the edges of other panels along a joist are ungrooved.

Preferably adhesive is applied to at least one edge of fixed panels prior to abutment thereagainst of a yet to be fixed panel.

Preferably the adhesive is of a solvent mastic type formulation with a synthetic rubber base. However other types of adhesive may be used, eg: epoxy or woodworking glues such as Resorcinol or PVA.

In another aspect the invention is a floor comprising a floor frame of primarily joists, and a plurality of abutting panels positioned on top of said floor frame to define the desired floor shape, adjacent edges of adjacent panels which are substantially perpendicular to the joist axes and are unsupported by nogs being fixed by adhesive one edge to another.

In another aspect the invention is a method of edgewise joining flooring panels which comprises fixing in place a first panel said panel having an edge provided with at least one groove, applying adhesive into said groove(s), and abutting a second panel provided with at least one groove complementary to that of said first panel in the plane of the first panel, so that there is an adhesive joint having a resistance in shear to relative vertical movement of the panel edges as well as a forming of a spline between the panels moulded at least in part by the said complementary grooves.

In another aspect the invention is flooring or a floor formed by a method of the present invention.

In still a further aspect the present invention consists in a flooring panel useful in a method as previously set forth, said panel being of a composite form including wood fibre and having at least one grooved edge.

In another aspect the invention consists in a flooring panel in the form of a rectangular or square sheet having a pair of opposite edges provided with at last one groove.

Preferably the groove is in a longer pair of edges.

Preferably said groove(s) is(are) centrally positioned on such edges.

In still a further aspect the present invention consists in a floor comprising a floor frame of primarily joists, and a plurality of abutting panels positioned on top of said floor frame to define the desired floor shape, at least part of each adjacent edge of adjacent panels which is substantially perpendicular to the joist axes is provided with a groove which complements a corresponding groove of the adjacent edge of the adjacent panel, a spline having been moulded in said complementary grooves during adhesive butting of said edges after adhesive has been applied to at least one of said edges, said adhesive being of a type which assumes a shape retaining form sufficient to serve a spline function in addition to any adhesive function it may provide.

In still a further aspect the present invention consists in a floor as just defined when formed by any method as previously defined.

BRIEF DESCRIPTION OF DRAWINGS

Preferred forms of the present invention will now be described with reference to the accompanying drawings in which

FIG. 1 shows the prior art method of using floor panels. In such a method a floor panel 1 is usually fixed both by adhesive and nailing at at least its periphery on the suspended floor frame 2 which comprises at least joists 3 which run in parallel. In addition nogs 4, which must be cut for length and be positioned appropriately between adjacent joists 3, underlie the abutment edge of the panel 1 with the adjacent panel. The same procedure follows throughout the whole floor.

By reference to "abutment" with adjacent panels please appreciate that this term includes actual physical abutment panel to panel as well as abutment through an adhesive medium. In some instances "abutment" may mean close proximity but preferably it does mean actual physical edgewise touching panel to panel or indirect panel to panel touching through an adhesive joint providing adhesive layer.

Figure 2:
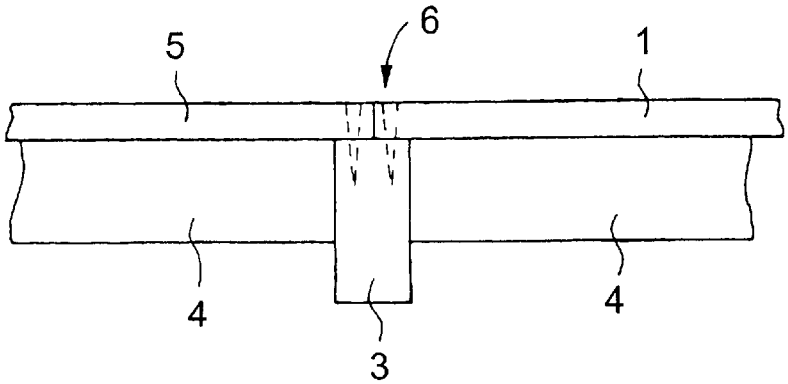
FIG. 2 shows how penetrative means such as nails or screws (shown in broken outline) may be used alone or in conjunction with adhesion to fix each peripheral region of butting flooring panels to either a joist or a nog, FIGS. 3A, B and C show some options for a preferred rectangular panel of the present invention, FIG. 3A showing a most preferred option where two groovings of edges of the flooring panel (preferably of a suitable particle board) is provided on the longer opposed pair of sides, FIG. 3B showing an alternative where there is machining only on the shorter of the opposed pair of sides, and FIG. 3C showing where there is machining all around the panel (obviously there is the option of the provision of grooving on a single edge or a pair of adjacent edges only etc.)

FIG. 2 shows the arrangement of the prior art panel looking along a joist 3 with one panel 1 abutting an adjacent panel 5 and being fixed into the joist 3 by appropriate nails or screws 6. The same procedure would be shown were one to look along the axis of a nog 4.

The present invention recognises that the expense and time involved in accurately positioning nogs so that every line of abutment between adjacent panels is on the axis of a framing member (whether it be a joist or nog) can be avoided. Since joists are preferably always present conventional abutment on the line of the joists can occur but to avoid the need for nogs preferably the jointing procedure of the present invention is adopted so as to provide for a resultant floor the requisite strength characteristics and without the likelihood of "squeaking" owing to nog shrinkage or skewing.

Flooring panels take a variety of different forms. A preferred form is that of a composite product including wood fibre typified by various commercially available panels as previously described. Within the ambit of such composite material are such products as particle board, MDF, plywood, etc.

Figure 3A:
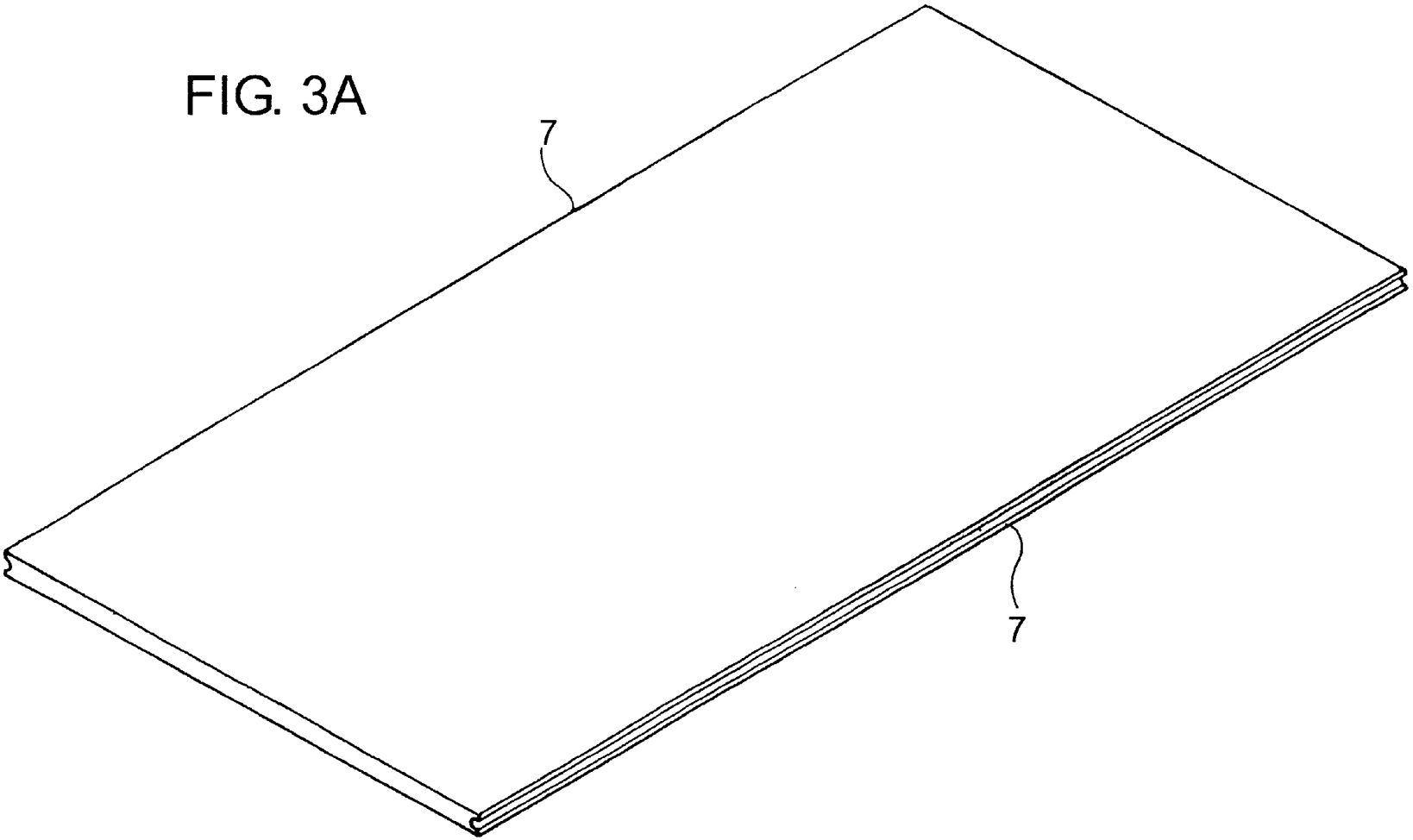
Figure 3B:
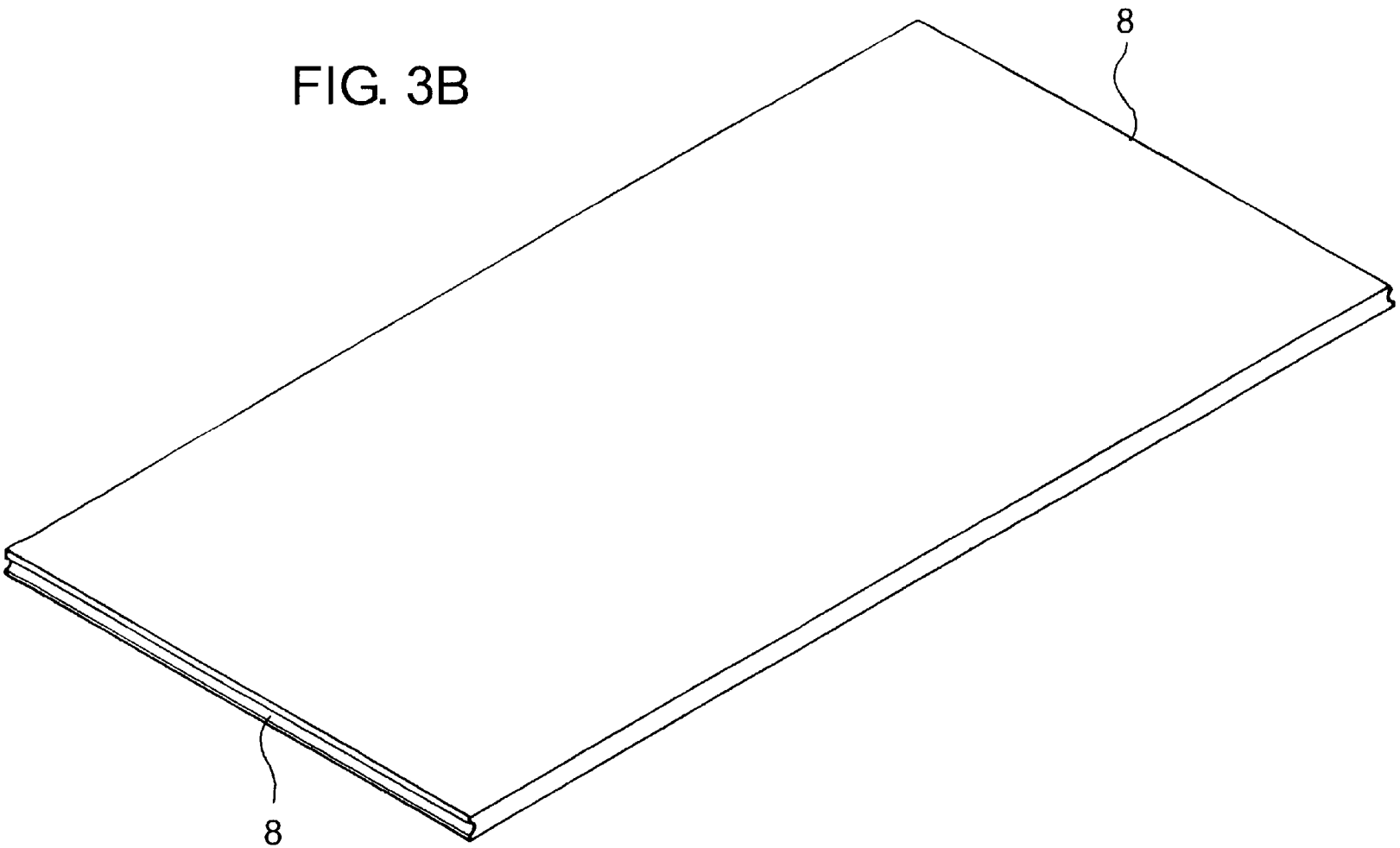
Figure 3C:
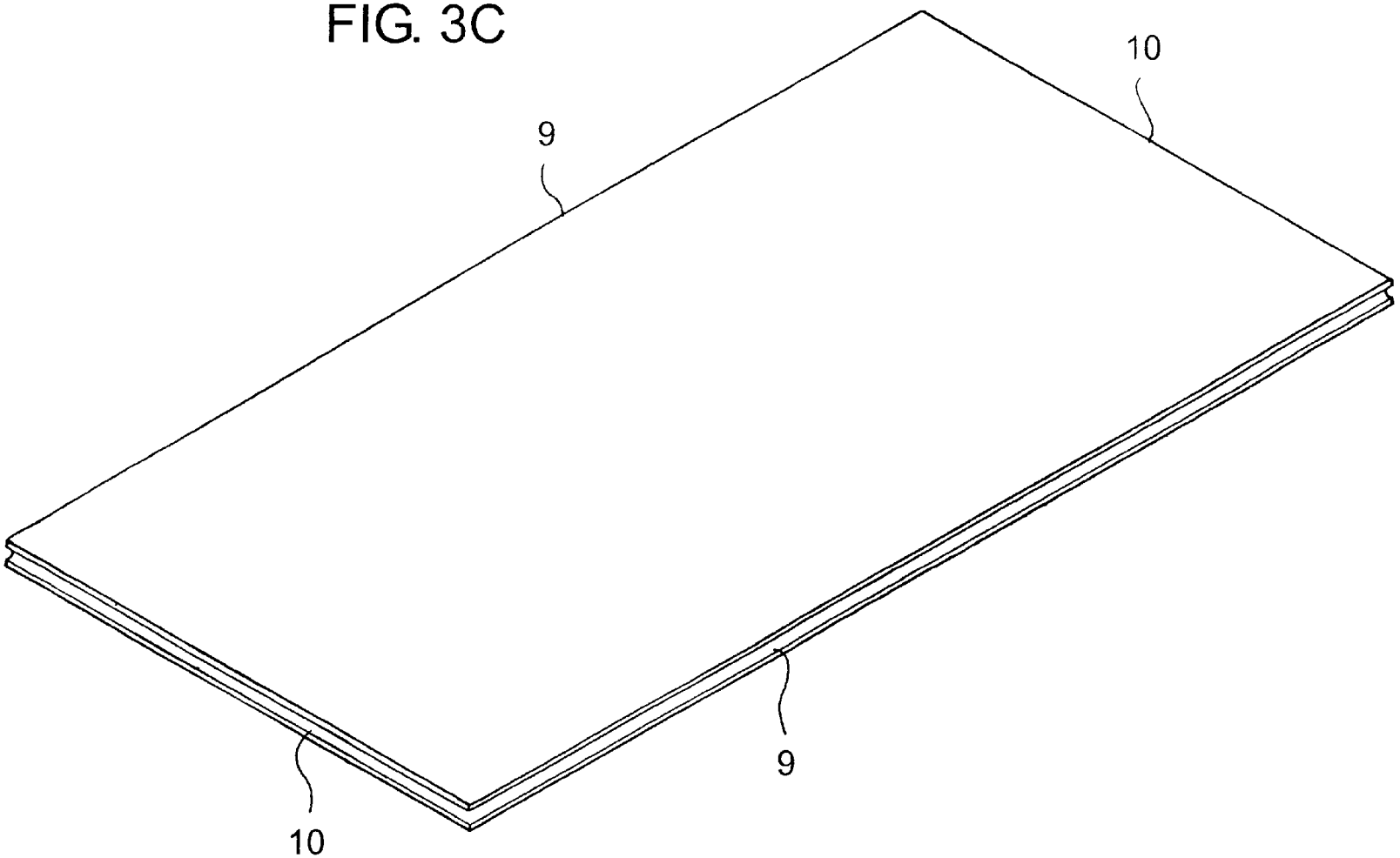

FIG. 3A through 3C shows a variety of different panels of a kind that it is envisaged can be manufactured in a factory and be supplied to a site for installation prior to there necessarily being any damage of consequence to the modified edges shown, ie; there are no easily damaged tongues.

In the panel of FIG. 3A, the opposed longer edges 7 are each provided with grooving.

In the panel of FIG. 3B the smaller opposed pair of sides 8 are instead grooved. Such a panel may have some application in assisting panel layout staggering to better tie a floor together.

Another form for the panel is as shown in FIG. 3C where edges 9 and 10 are all grooved. Such a form of the panel however is more expensive than that of FIG. 3A or FIG. 3B since routing of the opposed edges during manufacture is not as simple where routing is required only to provide two opposed pairs of grooved sides.

Obviously forms of panel in accordance with the present invention can be provided which are grooved on one side only.

Still other forms of panel may be other than rectangular or indeed even square. There may well be structures where the floor frame is framing an area other than one which lends itself to rectangular or square panel forms in which case complex panels having curved, triangulated or other edges may be utilised. Even for such arrangements however, where there is to be abutment otherwise than on the line of a joist, the procedure of the present invention is believed to have application.

Figure 4:
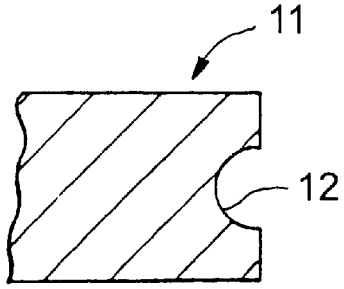
FIG. 4 is a cross section of a preferred flooring panel showing the nature of a preferred form of the groove provided therein.

Preferably the edges as depicted in FIGS. 3A through 3C for a panel 11 are as shown in FIG. 4 as 12.

Figure 5A:
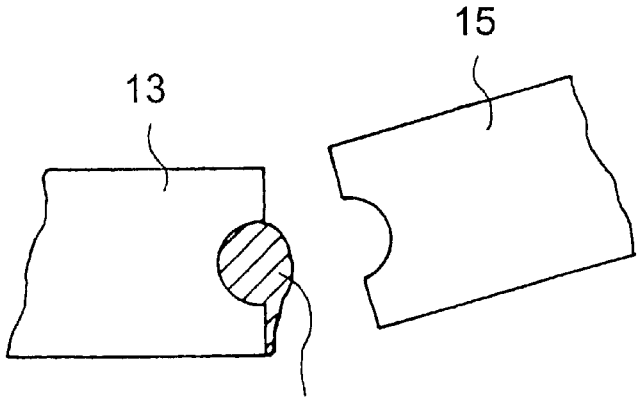
FIG. 5A shows a panel of the kind depicted in FIG. 4 having a bead of glue applied into the groove of that panel that has already been fixed in place (or vice versa also being an option) and a like panel being brought into abutment therewith.
Figure 6:
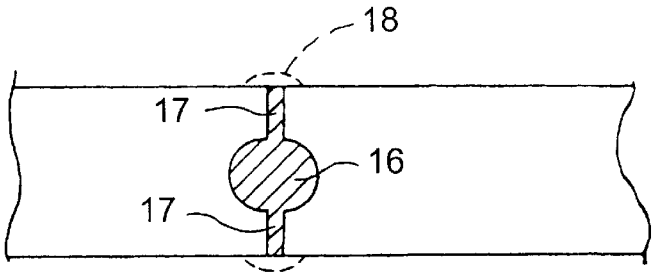
FIG. 6 is the outcome of a butting together of the panel edges by a procedure of either FIG. 5A or FIG. 5B, the dotted lines showing adhesive that is preferably squeezed from between the panels which at least in respect of the top edge can be easily scraped away.

FIG. 5A shows how, for example, one panel (preferably already fixed) 13 may have a bead of appropriate liquid (yet viscous) adhesive 14 applied thereto prior to the complementary edge of a panel 15 being brought into engagement therewith so as to provide the abutment arrangement as shown in FIG. 6 where the complementary grooves at least substantially shape at least a partial intermittent or continuous spline like structure upon the curing, hardening or the like of the adhesive, preferably also in conjunction with an adhesive interface between the non grooved edge regions of each panel.

Figure 5B:
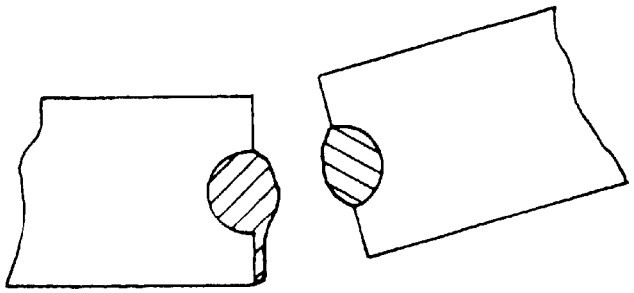
FIG. 5B shows a variant where there is an application of a bead of adhesive in the grooves of both panels prior to the creation of the abutment.

FIG. 5B is a variant of the arrangement of FIG. 5A where in this form adhesive is applied into both grooved edges prior to their being brought into the abutment substantially as shown in FIG. 6.

Figure 21:
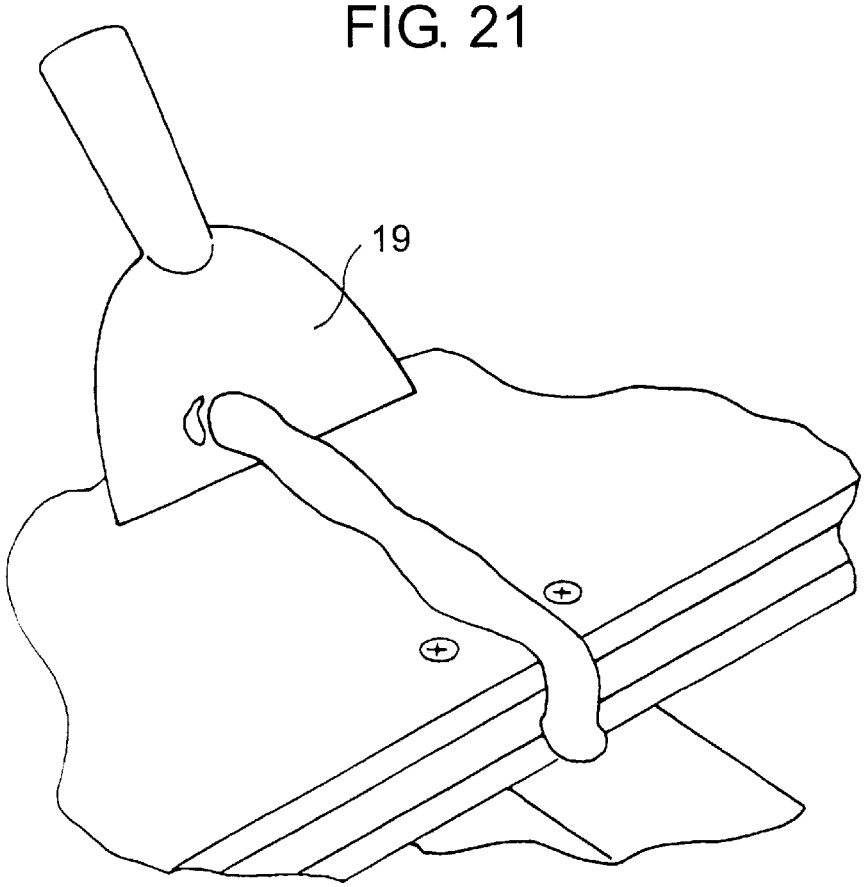
FIG. 21 shows how the overflow of adhesion from the joint is preferably removed.
Figure 22:
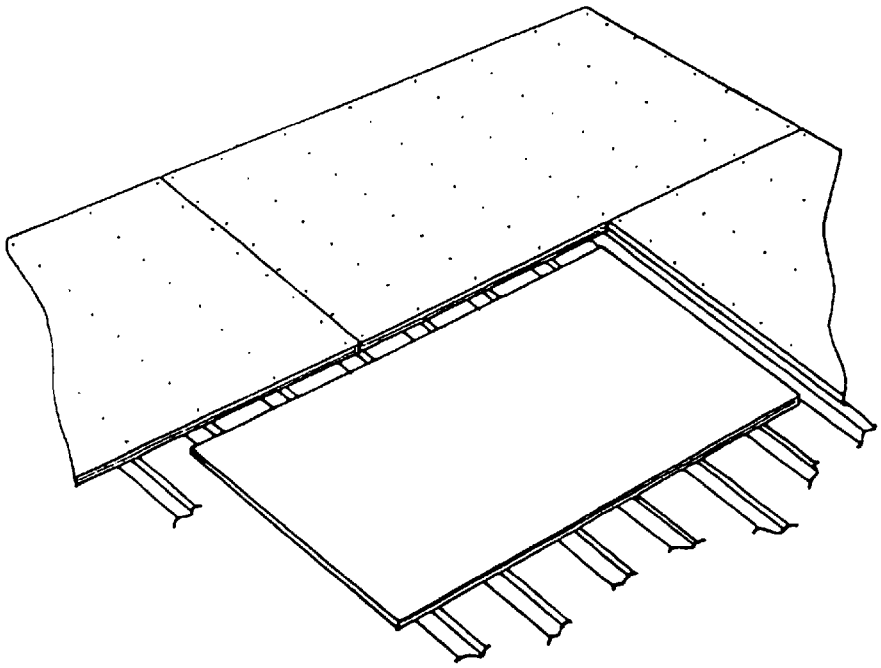
FIG. 22 shows how a similar grooved panel in a lapping relationship previously referred to can be fitted, FIG. 23 showing how a bead of adhesive is applied at least into the groove of the fixed and the panel then brought into the abutment to provide the effect as shown in FIGS. 20 and 21 for the non grooved abutment over the joist and a like arrangement to that of FIGS. 20 and 21 even for the grooved arrangement which results in the outcome as depicted in FIG. 6, such outcome being the provision of an adhesive jointing of the panel edges to each other and the provision of an adhesive formed spline between the panels where such panels are not supported by nogs.
Figure 23:
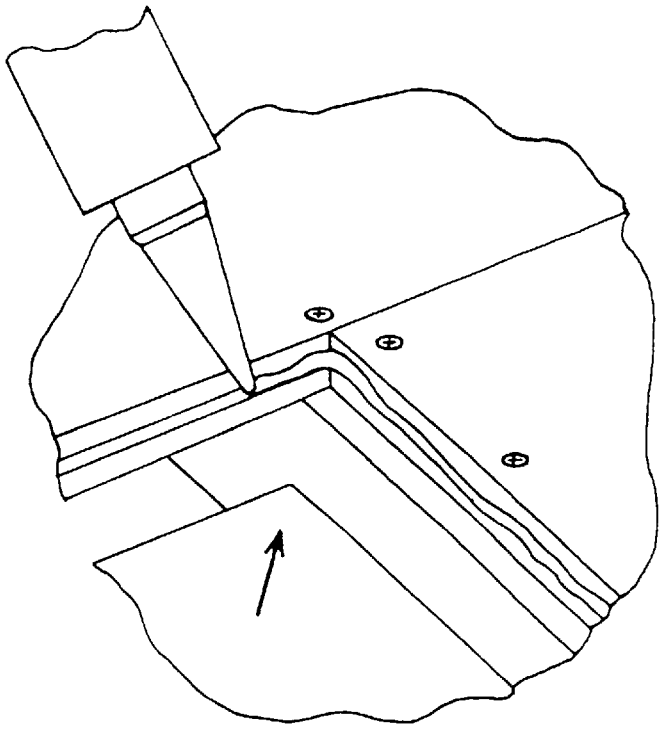

As can be seen (FIG. 6) a spline like structure 16 results in addition to preferably adhered regions 17. Overflow of the adhesive shown in dotted outline as 18 can easily be scraped away as shown, for example, in FIG. 21 which shows a scraper 19.

Figure 7:
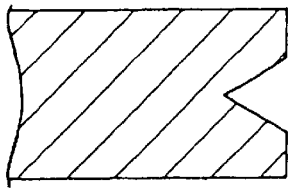
FIG. 7 is a similar view to that of FIG. 4 but showing a different form of groove.
Figure 8:
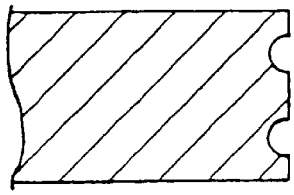
FIG. 8 shows still a further variant reliant on multiple grooves.
Figure 9:
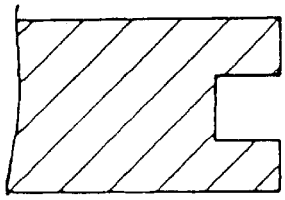
FIG. 9 shows still a further groove option.

Other forms of groove which adapt to complementary panels are those depicted in FIGS. 7 through 9. In each instance it is to be seen that irrespective of whether or not there is one or two grooves (indeed there might even be more) preferably the positioning of the grooves is such that does not matter which way up the panel is positioned. Should however a particular composite material have a surface that must be uppermost this symmetry of the groove provision is not mandatory. In such arrangement asymmetric positioning of a single or multiple grooves can be provided knowing that they will match and complement a similarly configured panel which likewise must also have a predetermined face uppermost.

Figure 10:
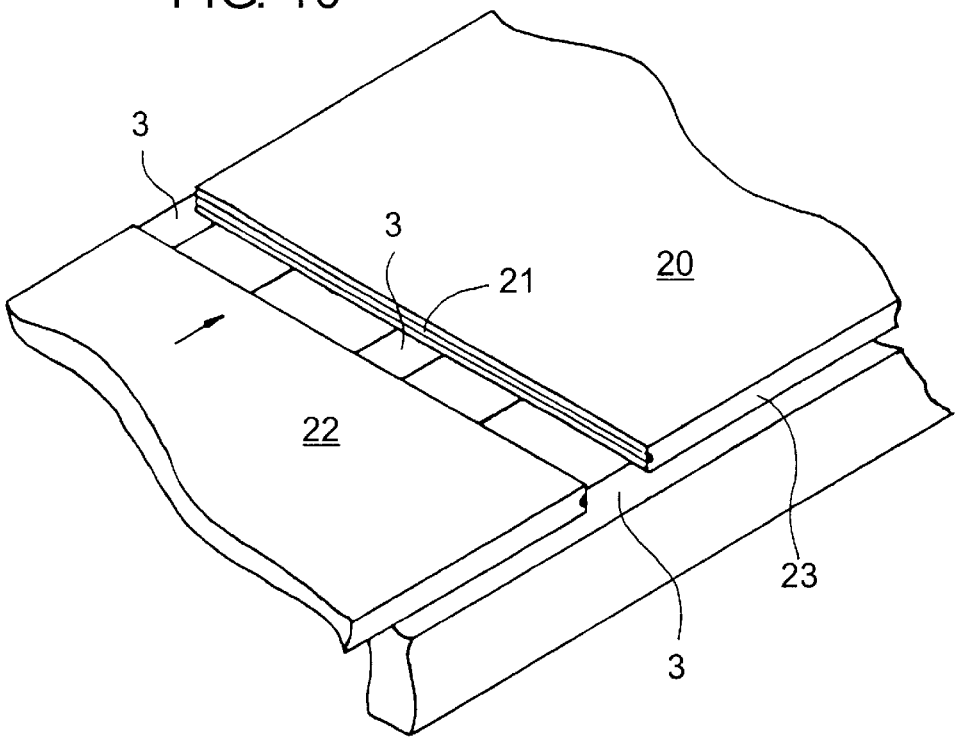
FIG. 10 shows panels of a kind as depicted in any of FIGS. 3A onwards being brought into abutment over some flooring joists without nogs underlying the line of joint, the edges being grooved.

FIG. 10 shows an arrangement where parallel joists 3 support a first panel 20 thereon with its grooved edge 21 substantially normal to the run of the joists 3. Panel 20 is to be abutted with a similar panel 22 which will move in the arrowed direction so as to bring its grooved edge into abutment (preferably through an interface of adhesive).

Figure 11:
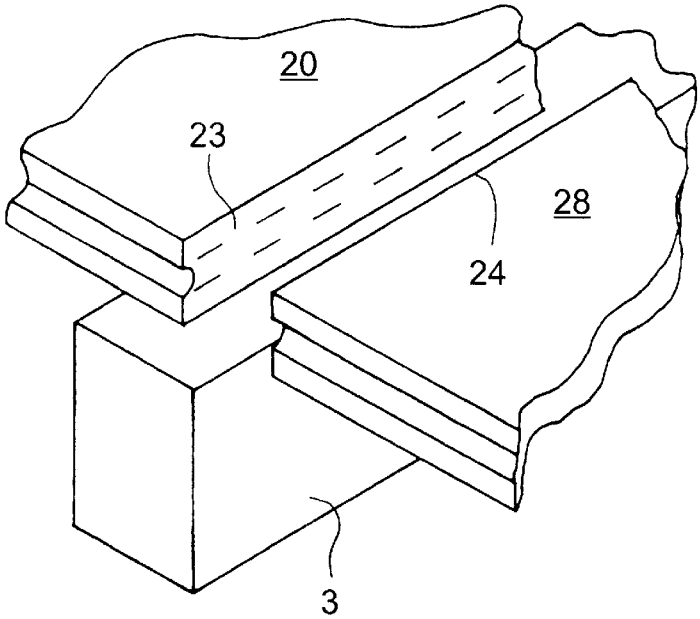
FIG. 11 shows how if desired a joist can underline mating panels which are free of any groove, the provision of an optional groove even at that line of abutment being depicted by the broken lines.

FIG. 11 however shows how that edge 23 of a floor panel 20 need not be grooved although the broken lines in FIG. 11 show that optionally (where a panel embodiment as shown, for example, 3C is used) that edge may also be grooved. In such a form as shown in FIG. 11 despite nails, screws or the like preferably being used preferably also there is an application of adhesive between the complementary faces 23 and 24 much in the conventional way.

Figure 1:
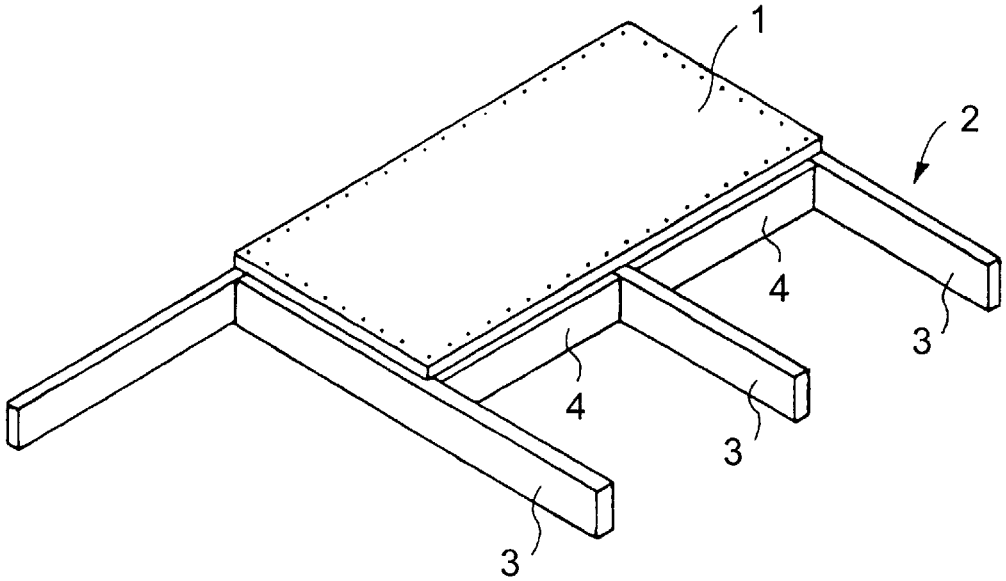
FIG. 1 shows a flooring panel of a reconstituted material (eg; particle board) showing how it is positioned and fixed so that its perimeter can subsequently edgewise butt adjacent panels (not shown) from a number of directions over a support element which is either a joist or a nog.
Figure 12:
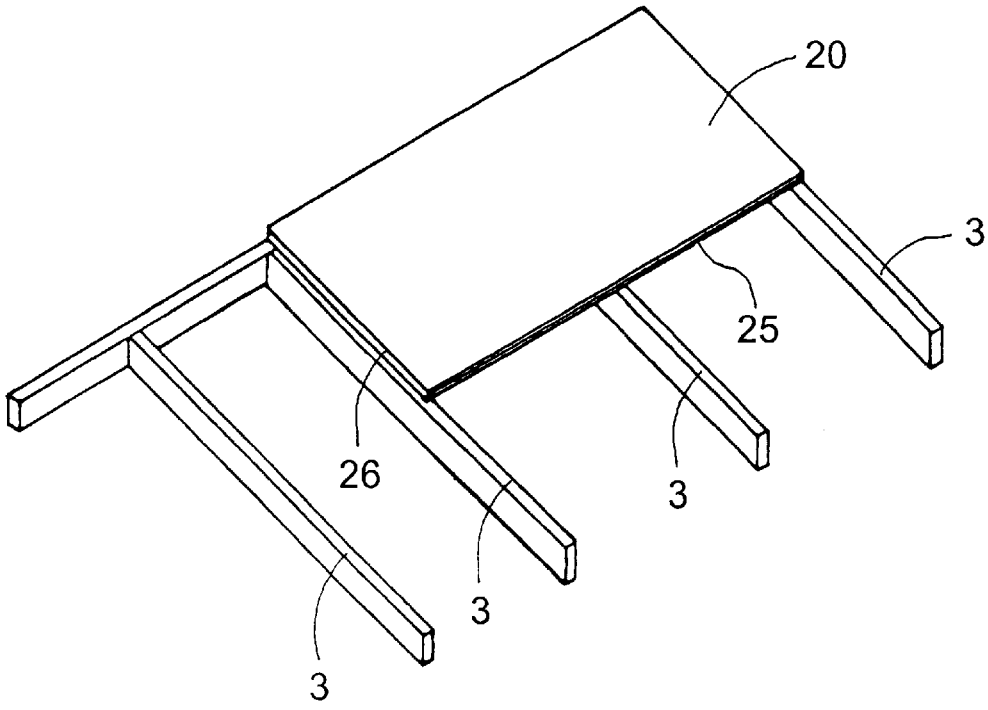
FIG. 12 shows how in accordance with the present invention a suspended flooring frame primarily of joists can have a panel arranged to be fixed directly into the peripheral framing member and the joists and can present an edge for abutment along a joist and perpendicular to the joists without a need for nogs.

Thus FIG. 12, in a manner as shown in FIG. 1, shows the joists 3 are preferably not provided with any nogs and the vertical support for the panels on their grooved edges 25 and 26 is as described by reference to FIG. 10 and as disclosed with reference to FIG. 11.

Figure 13:
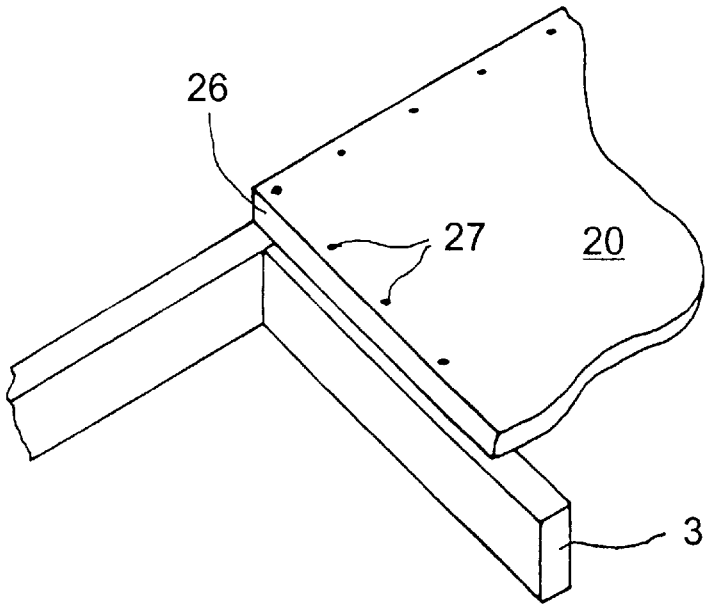
FIG. 13 shows the region A of FIG. 12.

FIG. 13 shows how preferably a plurality of nails, screws or the like 27 are preferably provided along the periphery in conjunction with any application of adhesive on to the frames much in the conventional way.

Figure 14:
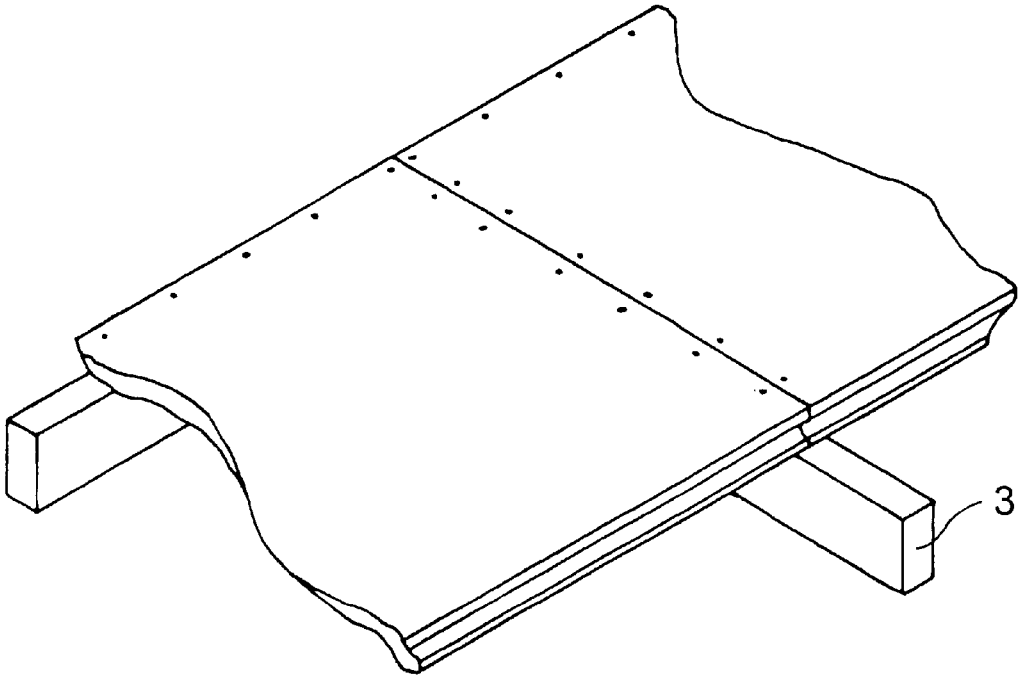
FIG. 14 shows how a panel such as depicted in FIG. 12 and FIG. 13 can butt against a like panel.
Figure 15:
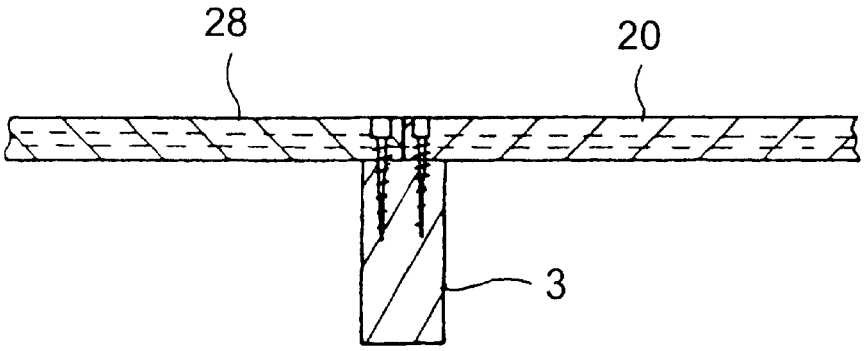
FIG. 15 is a similar view to that of FIG. 2 which was a prior art arrangement but showing in section the same type of arrangement but this time restricted to a joist, i.e. no nog being necessary, the broken lines showing this is the grooved panel form.

FIG. 14 in a manner similar to FIG. 13 shows how an abutment of the kind referred to in FIG. 11 results. FIG. 15, looking along the joist 3, shows how the adjacent panels 20 and 28 are fixed by screws, nails or the like into the joist 3.

Figure 16:
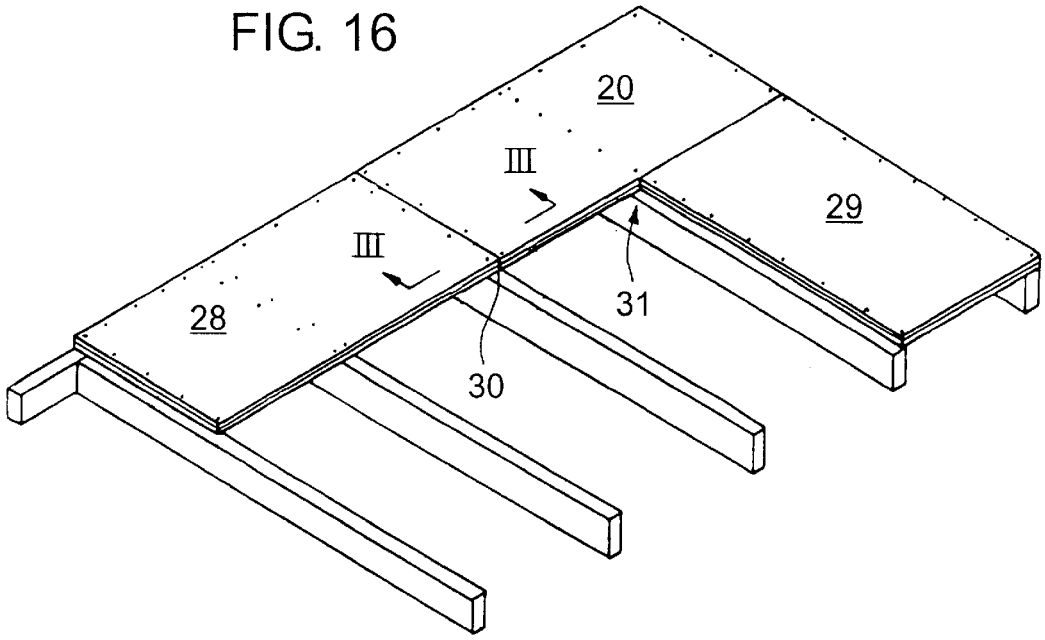
FIG. 16 shows an arrangement whereby to provide lap a panel of a rectangular form as depicted in FIG. 12 can be rotated by 90° at one part, the shorter edge in such an arrangement preferably being grooved or overlying a nog (not shown)

FIG. 16 shows how, if desired, a panel 29 of the kind depicted in either FIG. 3B or 3C can be utilised with its major axis aligned differently the major axes of other panels (eg; panels 20 and 28) so as to ensure a panel yet to be laid with its major axis parallel to the major axes of panels 20 and 28 will lap over the joint region 30 if desired.

Figure 17:
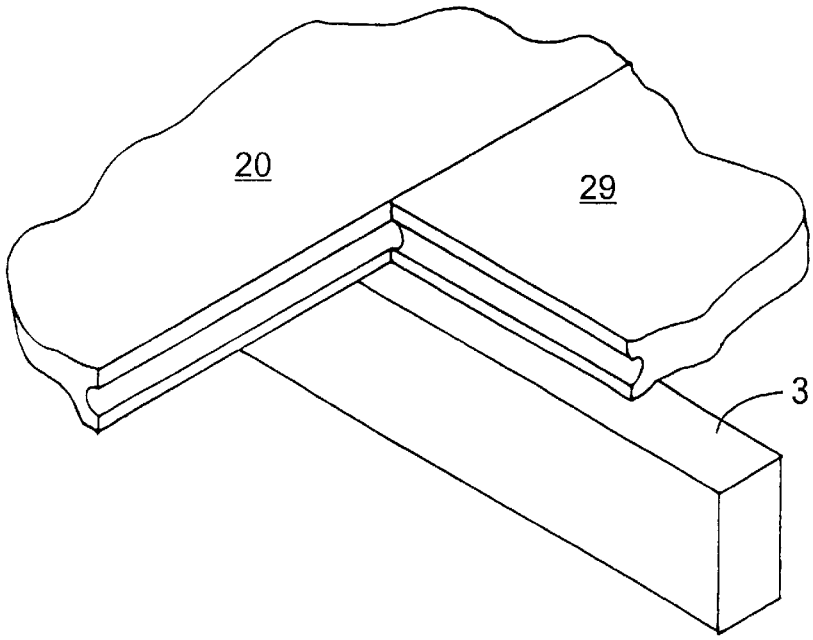
FIG. 17 shows how if desired a joist can underlie a grooved edge of a panel in abutment with an already fixed panel.
Figure 18:
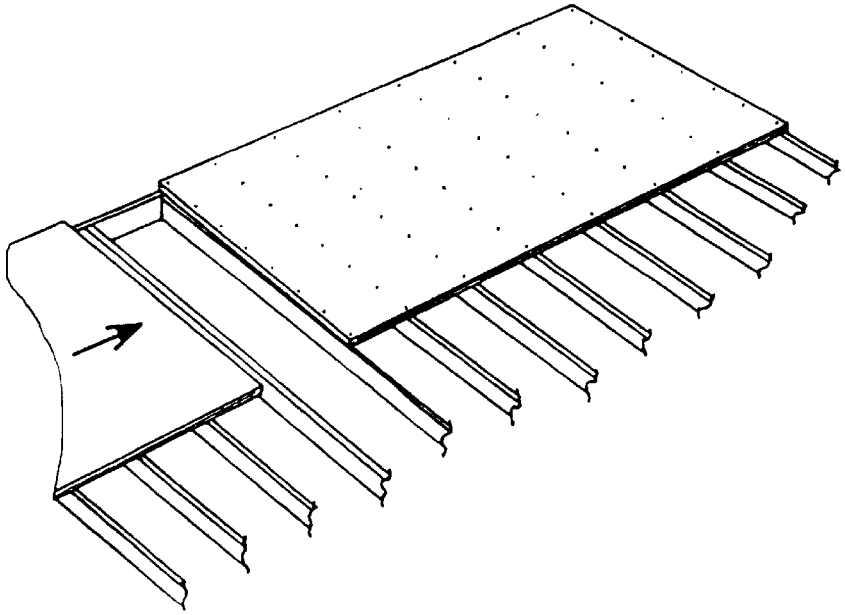
FIG. 18 shows a preferred form of flooring with the present invention a first panel having been fixed by both adhesion and screwing to present a grooved edge perpendicular to the joist run direction and a like panel being brought into abutment thereof, FIG. 19 showing how preferably a bead of suitable adhesive is provided on the preferably non-grooved edges for such butting over the joists.
Figure 19:
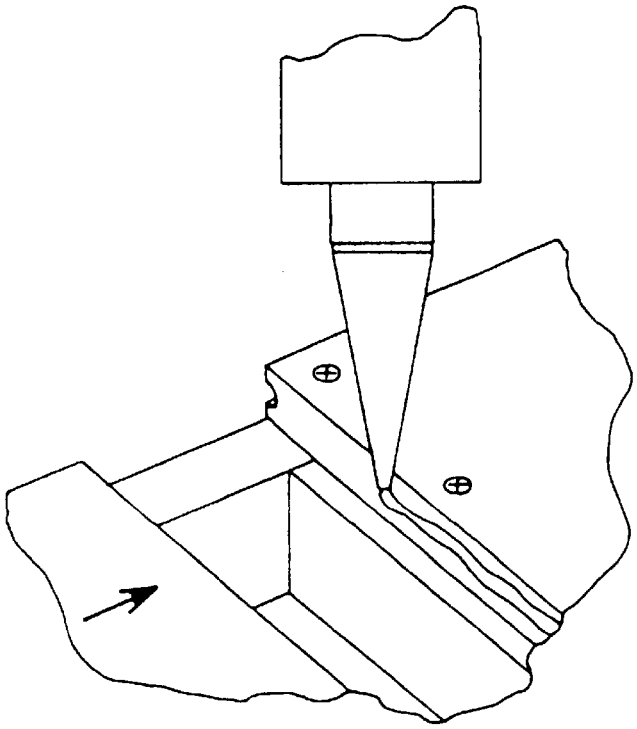
Figure 20:
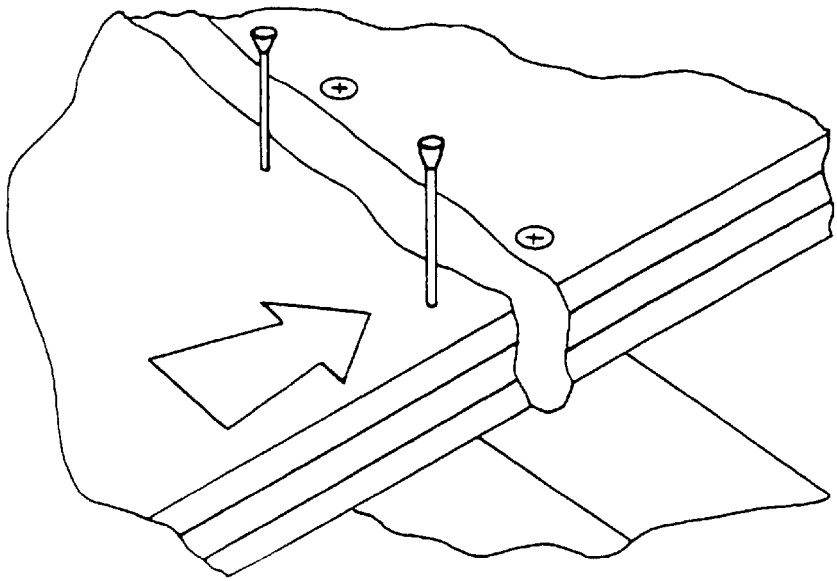
FIG. 20 shows the butting of the arrangement of FIG. 19 with glue spill over which then indicates the appropriateness to then screw or nail home the panel into its fixed position.

FIG. 17 is a close up of the region 31 of FIG. 16.

The preferred form of the present invention will now be described with respect to the installation sequence of FIGS. 18 through 23.

By way of example, KOPINE Ultralock™ particle board floor panels of this company of sheet size of either 2400×1200×20 mm or 3600×1200×20 mm are preferably used. KOPINE Ultralock™ particle board is a reconstituted wood panel manufactured by bonding pine wood particles with a melamine urea formaldehyde resin using a combination of heat and pressure. Such a particle board has average values when tested to AS/NZS 4266:1995 as follows;

| | | |
|---|---|---|
| • Density | kg/m3 | 710 |
| • Internal Bond | kPa | 900 |
| • Modulus of Rupture | MPa | 22 |
| • Modulus of Elasticity | MPa | 3000 |
| • Moisture Content | % | 8 |
| • Water Adsorption (one hour soak) | % | 4 |
| • Thickness Swell (one hour soak) | % | 2 |

Surface - Flake finish.

The adhesive preferably used in the procedure is any compatible spline forming adhesive preferably providable in a convenient cartridge size to fit a glue gun. An example of an appropriate adhesive is Fuller's Sturdibond™ Adhesive which is available in New Zealand. The adhesive is a solvent mastic type formulation with a synthetic rubber base and it is compatible with the KOPINE Ultralock™ composite panel.

The panels are designed with the grooving as depicted to be laid across joists and glued together at the edges. The continuous glue bond of the edges that do not overlie the axis of a joist eliminates the need for further edge support such as timber nogging.

Preferably all end joints (ie; of the opposed preferably ungrooved shorter edges) are made over the axis of a joist and are glued together.

Preferably joists are no more than 600 mm apart. For even greater strength and stiffness however joists may be set at a spacing of, for example, 400 or 450 mm.

Preferably the panels are laid in a staggered brick like pattern as described such that there is lapping to tie the floor/floor frame as a racking resistant structure.

The application of the preferred glue is to the single groove of the preferred panel and it is supplied as a continuous run of about 5 mm bead diameter. The bead size is correct when the adhesive squeezes out of the joint (top and bottom) as the panels are pushed together. This is preferably the case whether or not one is applying adhesive to the joist supported edges or the edges preferably normal to the run of the joists. Preferably however more adhesive is to be available for the splined joints (which preferably run normal to the run of the joists).

It is desirable that the panels be fixed by appropriate nailing or screwing within 15 minutes of the adhesive being applied.

Appropriate screws are 8-gauge×50 mm Sure-fast™ type countersunk screws. Appropriate nails if to be hand driven) are 60×2.8 mm hot-dipped galvanised particle board nails. Power driven nails may also be used.

Adhesive fastening of the panels to the joists may be used alone or in conjunction with the penetrative fixing. If there is to be such adhesion down on to the framing members preferably a 10 mm bead of Fuller's Sturdibond™ is applied to the joists and a 5 mm bead to the panel edges prior to the panels being positioned.

The present invention recognises a desirability to reduce reliance on nogging in the provision of a floor supported by a floor frame. The present invention also by adopting the grooved edge feature in mated panels has enabled greater glue retention in the joint than is possible with straight square edged abutment. This enhanced glue retention better copes with movement after laying prior to the glue being cured. In the long term such glue in the mated grooves provides the added security of a physical "key" or "spline" between the panels to augment the glue bond.

With the prospect that some tradesmen may have insufficient training or ability, the advantages offered by the grooved edges for gluing provides an added assurance that an effective bonded panel to panel joint will result. Even with such joints soon after cure of the bonding adhesive, greater consistency of performance over simple square edge adhesive joints results. There is also an improvement in resistence to failure under load in shear.

Persons skilled in the art will appreciate how the flooring thus laid after an appropriate setting time can then be finished to appropriate standard.

What is claimed is:

1. A method of edgewise joining flooring panels to provide a floor structure, said method comprising providing a flooring frame including a plurality of parallel extending joists, positioning and fixing a first panel on said flooring frame so as to reveal a grooved edge extending perpendicular to a longitudinal axis of said plurality of parallel extending joists, positioning and fixing a second panel on the flooring frame, said second panel having a grooved edge mated to said grooved edge of said first panel and positioned perpendicular to the longitudinal axis of said plurality of parallel extending joists so that said grooved edge of said first panel and said grooved edge of said second panel are located between adjacent perpendicular extending joists with support of said first panel and support of said second panel from underneath is provided only by said adjacent joists, and applying a liquid adhesive to at least one of said grooved edges of said first panel and said second panel prior to bringing the first and second panels together into their mated condition and the fixing of the second panel to the flooring frame, and said first and second panels being permanently secured together by said adhesive.

2. A method of claim 1 wherein said panels are each of a composite which includes wood fibre material or at least included wood fibre material.

3. A method of claim 1 wherein said first panel is fixed prior to the positioning and fixing of the second panel.

4. A method of claim 1 wherein the fixing of each panel includes one of nailing and screwing into said joists.

5. A method of claim 1 wherein said panels are rectangular and are grooved on two opposed sides only, said two opposed sides being normal to the run of the joists.

6. A method of claim 1 wherein said panels are rectangular and at least the two longer sides are grooved.

7. A method of claim 6 wherein those edges of panels to be adjacent the edges of other panels along a joist are ungrooved.

8. A method of claim 1 wherein the adhesive is of a solvent mastic type formulation with a synthetic rubber base.

9. Flooring or a floor formed by a method of claim 1.

10. A flooring panel useful in a method of claim 1, said panel being of a composite material including wood fibre or which included wood fibre as a raw material and having at least one grooved edge.

11. A flooring panel of claim 10 in the form of a rectangular or square sheet having a pair of opposite edges provided with at least one groove, fully extensive with a length of each edge.

12. A panel of claim 11 wherein the groove is in a longer pair of edges.

13. A panel of claim wherein said at least one groove is centrally positioned on said edges.

14. A method of edgewise joining flooring panels, said method comprising fixing in place a first panel, said panel having an edge provided with at least one groove and extending perpendicular to a longitudinal axis of a plurality of parallel extending joists with said first panel positioned between adjacent joists, applying adhesive into said at least one groove, abutting a second panel provided with at least one groove complementary to said at least one groove of said first panel in a plane of the first panel said at least one groove of said second panel extending perpendicular to the longitudinal axis of said plurality of parallel extending joists and said second panel extending between said adjacent joists so that said first panel and said second panel are supported from underneath only by said adjacent joists, applying an adhesive joints having a resistance in shear to relative vertical movement of the panel edges as well as forming of a spline between the panels moulded at least in part by said complementary grooves, with said adhesive joint between said first panel and said second panel permanently securing said first panel to said second panel.

15. A floor comprising a floor frame of a plurality of parallel extending joists, a plurality of abutting panels positioned on top of said floor frame and extending between adjacent joists to define a desired floor shape, at least part of each adjacent edge of adjacent panels extending substantially perpendicular to longitudinal axes of said joists and including a groove complementing a corresponding groove of the adjacent edge of the adjacent panel, said adjacent panels being supported from underneath only by said adjacent joists, a spline formed of adhesive moulded in said complementary grooves during adhesive butting of said edges after adhesive has been applied to at least one of said edges, said adhesive assuming a shape retaining form sufficient to serve a spline function in addition to any adhesive function of permanently securing said adjacent panels.

16. A floor comprising a floor frame of a plurality of parallel extending joists, a plurality of abutting panels positioned on top of said floor frame and extending between adjacent joists to define a desired floor shape, adjacent edges of adjacent panels each having a groove extending substantially perpendicular to longitudinal axes of the joists and said adjacent panels extending between said adjacent joists and being supported from underneath only by said adjacent joists, said adjacent panels being fixed by adhesive in said grooves one edge to the other said adhesive forming a spline for permanently securing said adjacent panels.

* * * * *